US010486862B2

(12) United States Patent
Krause

(10) Patent No.: US 10,486,862 B2
(45) Date of Patent: Nov. 26, 2019

(54) BAG DISPENSER FOR FACILITATING BAG OPENING

(71) Applicant: Walmart Apollo, LLC, Bentonville, AR (US)

(72) Inventor: Jacob C. Krause, Ward, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 368 days.

(21) Appl. No.: 15/461,818

(22) Filed: Mar. 17, 2017

(65) Prior Publication Data

US 2017/0267412 A1 Sep. 21, 2017

Related U.S. Application Data

(60) Provisional application No. 62/309,864, filed on Mar. 17, 2016.

(51) Int. Cl.
*B65D 33/00* (2006.01)

(52) U.S. Cl.
CPC ..... *B65D 33/007* (2013.01)

(58) Field of Classification Search
CPC .... A47F 13/00; A47F 9/042; A47F 2009/044; B65D 33/007; B65B 2067/1272
See application file for complete search history.

(56) References Cited

U.S. PATENT DOCUMENTS 4,537,376 A 8/1985 Buku
4,795,413 A 1/1989 Johnson
(Continued)

FOREIGN PATENT DOCUMENTS

CN 101445163 6/2009
CN 201647276 11/2010
(Continued)

OTHER PUBLICATIONS

"Produce Bags and Stand"; https://web .archive.org/web/20151129005343/http://www.uline.com:80/BL_7 4/Produce-Bagsand-Stand; Nov. 29, 2015; 2 pages.
(Continued)

*Primary Examiner* — William A. Rivera
(74) *Attorney, Agent, or Firm* — Fitch, Even, Tabin & Flannery LLP

(57) ABSTRACT

In some embodiments, methods and systems are provided that facilitate the opening of a mouth of a plastic bag when removing the plastic bag from a plastic product bag dispenser. The plastic product bag dispenser includes a frame including a spindle configured to hold and permit dispensing of a roll of plastic produce bags, a bag separator coupled to the frame configured to permit separation of a leading plastic produce bag from an adjacent plastic produce bag along the line of weakness, and a bag opening facilitator including a frictional element having a higher coefficient of friction relative to surfaces of the front and rear sidewalls of the plastic produce bag than portions of the bag separator adjacent the bag opening facilitator. The frictional element of the bag opening facilitator is configured to retain in place a portion of the rear sidewall proximate the openable mouth while permitting a portion of the front sidewall proximate the openable mouth to move relative to the retained in place portion of the rear sidewall to open the mouth of the plastic produce bag.

20 Claims, 3 Drawing Sheets

(56) References Cited

U.S. PATENT DOCUMENTS

| | | | | |
|---|---|---|---|---|
| 5,207,368 | A | 5/1993 | Wilfong, Jr. | |
| 5,556,019 | A | 9/1996 | Morris | |
| 6,135,281 | A | 10/2000 | Simhaee | |
| 6,199,788 | B1 * | 3/2001 | Simhaee | A47F 9/042 225/106 |
| 6,279,806 | B1 * | 8/2001 | Simhaee | A47F 9/042 225/106 |
| 6,561,403 | B1 | 5/2003 | Kannankeril | |
| 9,751,712 | B2 | 9/2017 | Helseth | |
| 2013/0111857 | A1 | 5/2013 | Rabiea | |
| 2013/0134181 | A1 | 5/2013 | Helseth | |
| 2015/0139571 | A1 | 5/2015 | Tseng | |
| 2015/0197375 | A1 | 7/2015 | Pontoriero | |
| 2016/0311636 | A1 | 10/2016 | Duda | |
| 2017/0029153 | A1 | 2/2017 | Beutler | |
| 2017/0029154 | A1 | 2/2017 | Beutler | |

FOREIGN PATENT DOCUMENTS

| | | |
|---|---|---|
| CN | 201907696 | 7/2011 |
| CN | 102351059 | 2/2012 |
| CN | 202012000590 | 4/2012 |
| CN | 103879613 | 6/2014 |
| DE | 102010019111 | 11/2011 |
| WO | 0125091 | 4/2001 |

OTHER PUBLICATIONS

PCT; App. No. PCT/US2017/022413; International Search Report and Written Opinion dated Jun. 8, 2017.

Yang, Sarah; "Engineers Create Gecko-inspired High-friction Microfibers"; http://www.berkeley.edu/news/media/releases/2006/08/22_microfiber.shtml; Aug. 22, 2006; 2 pages.

* cited by examiner

BAG DISPENSER FOR FACILITATING BAG OPENING

RELATED APPLICATIONS

This application claims the benefit of U.S. Provisional Application No. 62/309,864, filed Mar. 17, 2016, which is incorporated herein by reference in its entirety.

TECHNICAL FIELD

This disclosure relates generally to plastic bag dispensers and, in particular, to plastic bag dispensers that facilitate the opening of the bag by consumers.

BACKGROUND

Grocery products are often displayed to consumers in as loose items with plastic produce bags located near the grocery product displays to enable the consumers to place the grocery products the consumers pick from the displays into such plastic produce bags for purchase. The plastic produce bags are typically provided on plastic bag dispensers as cylindrical rolls containing a single continuous sheet including multiple plastic produce bags separable from each other along a line of weakness.

A consumer typically pulls the leading plastic produce bag of a roll over a separator tab of the plastic bag dispenser and then pulls this bag over the separator tab to separate the leading plastic produce bag from its adjacent plastic produce bag along the line of weakness. After the leading plastic produce bag is separated from the roll by the consumer, the same consumer or the next consumer can then pull and separate the next leading plastic produce bag from the roll using the procedure described above.

A problem with typical plastic produce bags provided on continuous sheet-based bag rolls is that the consumers often find it difficult to open the plastic product bags after they remove the plastic produce bags from the roll. In particular, the consumers may have difficulty finding the mouth of the plastic produce bag and/or distinguishing the mouth end of the plastic produce bag from the closed end of the plastic produce bag. In addition, after the plastic produce bag is separated from the roll by the consumer using a certain amount of force, the side walls of the plastic produce bag often stick to each other due to static, thereby interfering with the consumer's ability to open the mouth of the plastic produce bag. Consumers often become frustrated with their inability to open the mouth of a given plastic produce bag taken off a roll while their fingers are dry and spit on their fingers to facilitate sufficient friction between their fingers and the side walls of the plastic produce bag in order to open the mouth of the bag. A solution that overcomes such issues is needed.

BRIEF DESCRIPTION OF THE DRAWINGS

Disclosed herein are embodiments of systems, apparatuses, and methods pertaining to plastic produce bag dispensers including a frictional element that facilitates the opening of the plastic produce bags by a consumer. This description includes drawings, wherein.

Figure 1:
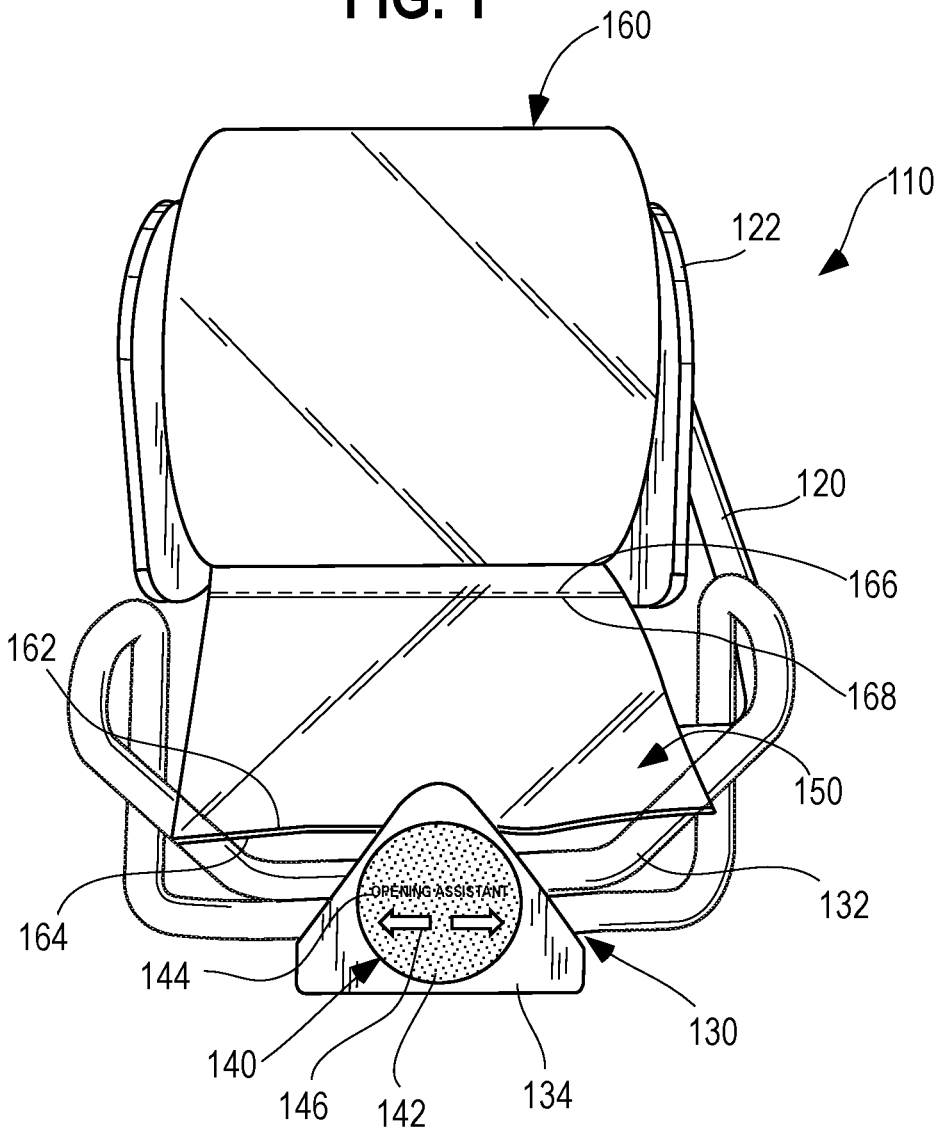
FIG. 1 is a front view of a plastic produce bag dispenser including a bag opening facilitator including a frictional element that facilitates the opening of the mouth of a plastic produce bag in accordance with some embodiments.

Elements in the figures are illustrated for simplicity and clarity and have not been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

The following description is not to be taken in a limiting sense, but is made merely for the purpose of describing the general principles of exemplary embodiments. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Generally speaking, pursuant to various embodiments, systems and methods are provided for facilitating a consumer to open a plastic bag by providing a plastic bag dispenser with a frictional element that enables the consumer to rub the front and rear sidewalls of the plastic bag together to create separation between the front and rear side walls of the plastic bag such the mouth of the plastic bag is opened.

In one embodiment, a plastic produce bag dispenser for facilitating a consumer to open a plastic produce bag includes: a frame including a spindle configured to hold and permit dispensing of a roll of plastic produce bags, each of the plastic produce bags in the roll including a front sidewall, a rear sidewall, an openable mouth proximate a first end of the plastic produce bag and a closed second end, adjacent plastic produce bags in the roll being separable from each other along a line of weakness; a bag separator coupled to the frame configured to permit separation of a leading plastic produce bag from an adjacent plastic produce bag along the line of weakness; and a bag opening facilitator including a frictional element having a higher coefficient of friction relative to surfaces of the front and rear sidewalls of the plastic produce bag than portions of the bag separator adjacent the bag opening facilitator. The frictional element of the bag opening facilitator is configured to retain in place a portion of the rear sidewall proximate the openable mouth when in contact with the portion of the rear sidewall proximate the openable mouth while permitting a portion of the front sidewall proximate the openable mouth to move relative to the retained in place portion of the rear sidewall to open the mouth of the plastic produce bag in response to a force applied by a consumer to the portion of the front sidewall proximate the openable mouth.

In another embodiment, a method of facilitating a consumer in opening a plastic produce bag includes: providing a roll of plastic produce bags on a plastic produce bag dispenser including a spindle, each of the plastic produce bags in the roll including a front sidewall, a rear sidewall, an openable mouth proximate a first end of the plastic produce bag, and a closed second end, the roll being configured such that adjacent plastic produce bags in the roll are separable from each other along a line of weakness; providing a bag separator configured to permit separation of a leading plastic produce bag from an adjacent plastic produce bag along the line of weakness; providing a bag opening facilitator including a frictional element having a higher coefficient of friction relative to surfaces of the front and rear sidewalls of the plastic produce bag than portions of the bag separator adjacent the bag opening facilitator; and retaining in place a portion of the rear sidewall proximate the openable mouth when in contact with the portion of the rear sidewall proximate the openable mouth while permitting a portion of the front sidewall proximate the openable mouth to move relative to the retained in place portion of the rear sidewall to open the mouth of the plastic produce bag in response to a force applied by a consumer to the portion of the front sidewall proximate the openable mouth.

FIG. 1 shows an embodiment of a produce bag dispenser 110 for facilitating a consumer in opening a plastic produce bag 150. The exemplary plastic produce bag dispenser 110 illustrated in FIG. 1 includes a frame 120 including a spindle 122 configured to hold and permit dispensing of multiple plastic produce bags 150. In the embodiment of FIG. 1, the plastic produce bags 150 are provided on the produce bag dispenser 110 in the form of a continuous roll of flexible material 160.

While this disclosure refers to plastic produce bags 150, it will be appreciated that bags other than plastic bags and bags other than produce bags (e.g., plastic and/or paper bags used to retain consumer goods) may be opened according to the principles described herein. The roll of flexible material 160 may be made of one or more polymers, laminates, metalized polymers, paper, or the like. In the embodiment shown in FIG. 1, the roll of flexible material 160 includes two layers of flexible material, with the upper layer 162 being a precursor for a front sidewall 152A of the plastic produce bag 150A when separated from the roll of flexible material 160 and the lower layer 164 being a precursor for a rear sidewall 154A of the plastic produce bag 150A separated from the roll of flexible material 160, as shown in FIG. 3.

With reference to FIG. 1, the exemplary leading plastic produce bag 150 may be separated from its adjacent plastic produce bag 150 on the roll of flexible material 160 along a line of weakness or score line 166. The line of weakness 166 may be formed in the roll of flexible material 160 using, for example, laser ablation, micro-abrasion, die-cutting, or other suitable techniques for creating lines of weakness in a flexible material. The line of weakness 166 in the roll of flexible material 160 ensures that, when a consumer applies a force by pulling the leading produce bag 150A away from its adjacent produce bag on the roll of flexible material 160 (as shown, for example, in FIG. 4), a tear between the plastic produce bags 150A and 150B is initiated at the line of weakness 166 and propagates along the line of weakness 166 to separate the leading plastic produce bag 150A from its adjacent plastic produce bag 150B. In other words, the line of weakness 166 provides an area of preferential tear initiation in the roll of flexible film material 160 and separation of adjacent plastic produce bags 150A and 150B from each other.

In the embodiment shown in FIG. 1, the roll of flexible material 160 includes a sealed portion 168 proximate the line of weakness 166. The sealed portion 168 may be formed by sealing together portions of the top and bottom layers 162 and 164 of the roll of flexible material 160 to each other using, for example, heat sealing, lamination, bonding, welding, UV-curing, fusion, adhesives, or the like. The sealed portion 168 is a precursor for a closed bottom end 158 of the plastic produce bag 150A separated from the roll of flexible material 160, as shown in FIG. 3.

Figure 3:
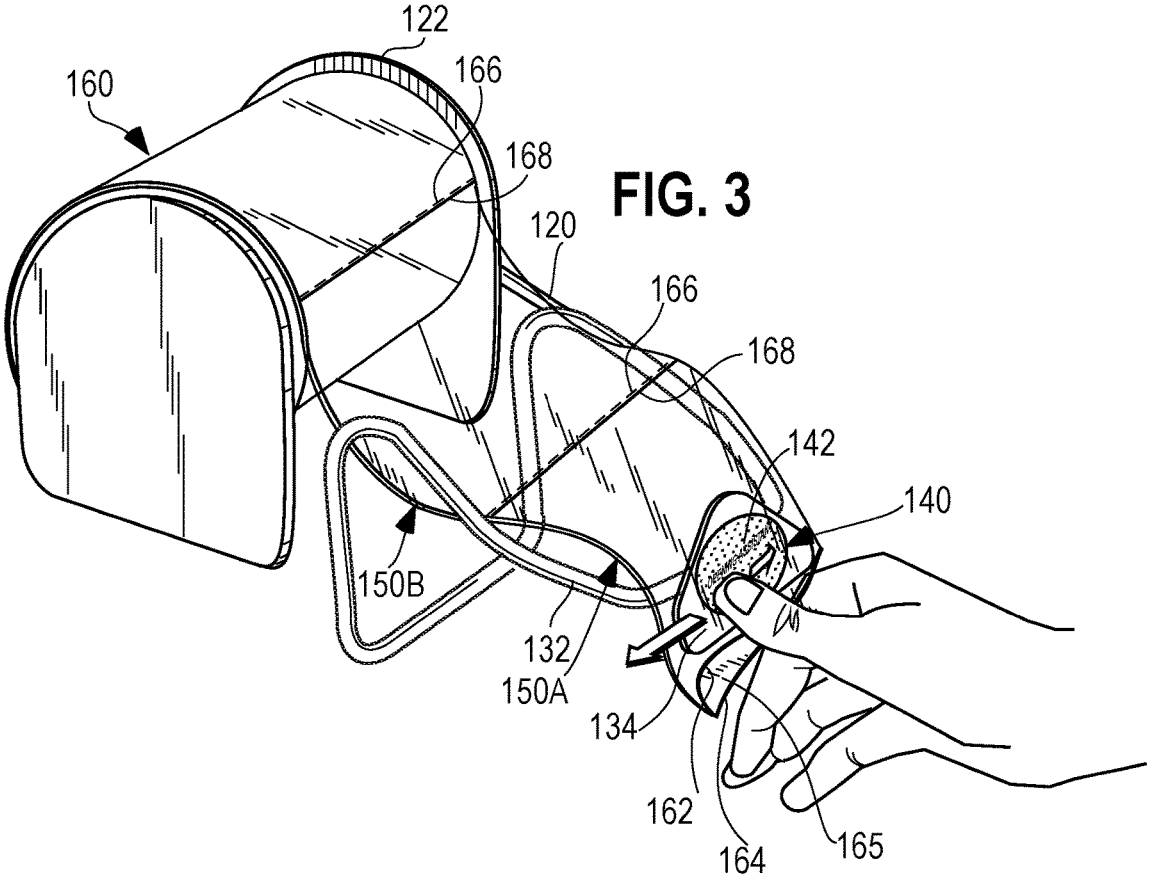
FIG. 3 is the same view as in FIG. 2, but illustrating the upper sidewall of the lead plastic produce bag being moved laterally relative to the lower sidewall of the lead plastic produce bag to open the mouth of the lead plastic produce bag.

An exemplary leading plastic product bag 150A shown in FIG. 3 includes a front sidewall 152A, a rear sidewall 154A, an openable mouth 155A proximate a leading end of the plastic produce bag 150A and a closed bottom end 158 proximate a trailing end of the plastic product bag 150A. When the lead plastic product bag 150A is separated from its adjacent plastic produce bag 150B along the line of weakness 166 as shown in FIG. 4, the sealed portion 168 forms a closed bottom end 158A of the separated plastic produce bag 150A, while the portion of the plastic produce bag 150B along the now ruptured line of weakness 166 forms the mouth 155B of the plastic produce bag 150B, which is initially in a closed configuration, as shown in FIG. 4.

Figure 2:
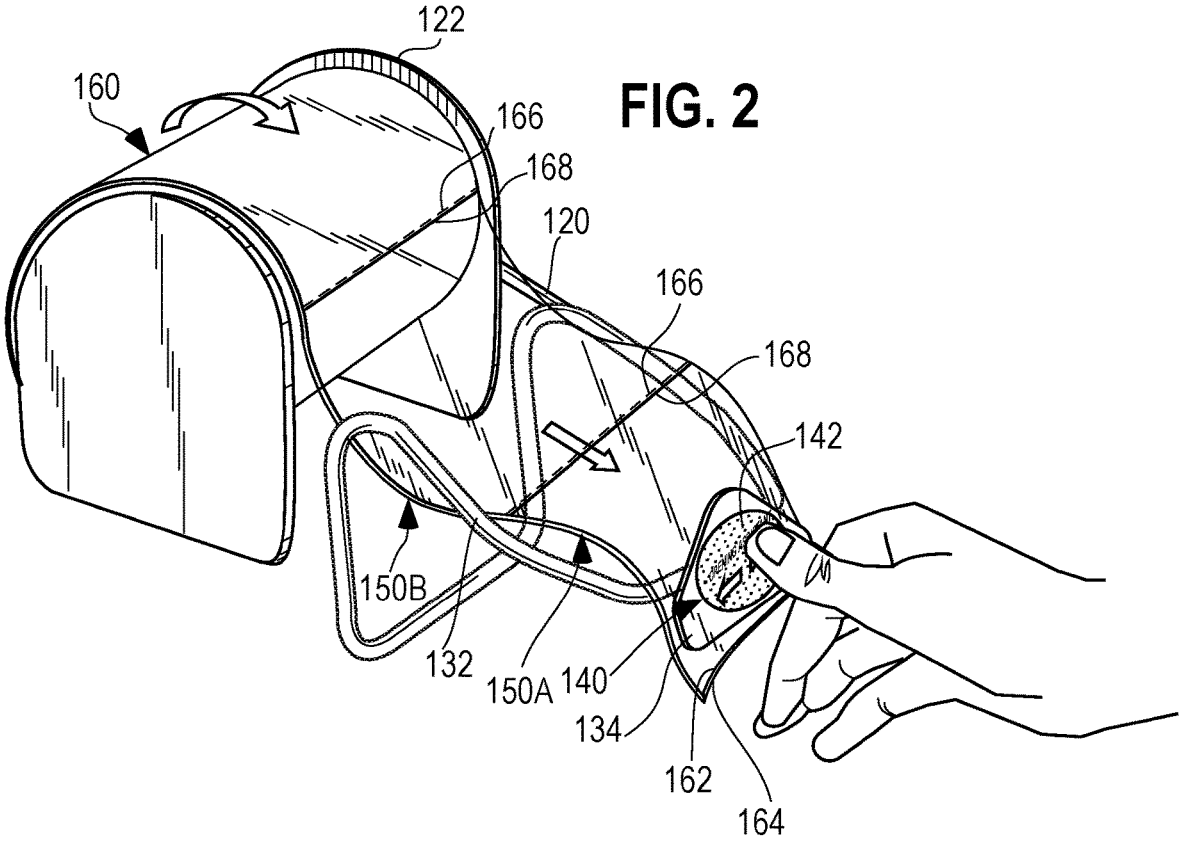
FIG. 2 is a perspective side view of the plastic produce bag dispenser of FIG. 1, with the lead plastic produce bag being pulled by a user over the bag opening facilitator.
Figure 4:
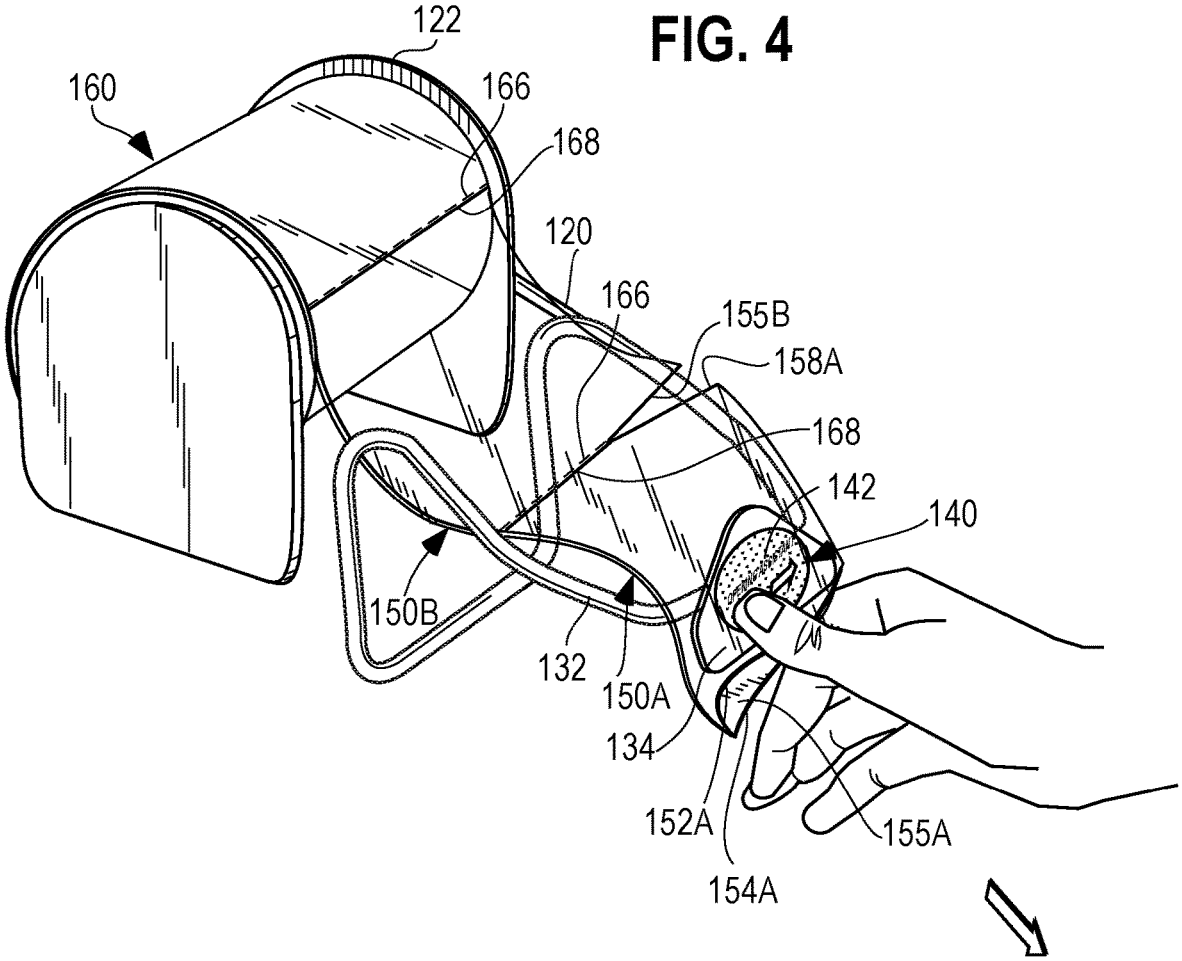
FIG. 4 is the same view as in FIG. 4, but illustrating the lead plastic produce bag being separated from its adjacent plastic produce bag along a line of weakness in response to a downward force applied by a consumer.

The produce bag dispenser 110 shown in FIGS. 1-4 further includes a bag separator 130 coupled to the frame 120. The bag separator 130 is configured to permit separation of the leading plastic produce bag 150A from the adjacent plastic produce bag 150B along the line of weakness 166. The bag separator 130 includes one or more supporting rods 132 that provide surfaces for supporting the plastic produce bag 150A as it is fed over the bag separator 130 as shown in FIGS. 2 and 3, and a separator tab 134 coupled to one or more of the supporting rods 132 and configured to facilitate separation of the leading plastic produce bag 150A from its adjacent plastic produce bag 150B along the line of weakness 166, as shown in FIG. 4.

In the embodiments shown in FIGS. 1-3, the produce bag dispenser 110 includes a bag opening facilitator 140 including a frictional element 142 having a higher coefficient of friction relative to the exterior surfaces of the front sidewall 152A and rear sidewall 154A of the plastic produce bag 150A as compared to the coefficient of friction of the exterior portions of the (preferably metallic or plastic) supporting rods 132 and the separator tab 134 of the bag separator 130 adjacent the bag opening facilitator 140. In some embodiments, as described in more detail below and shown in FIG. 3, the frictional element 142 of the bag opening facilitator 140 is configured to retain in place a portion of the rear sidewall 154A of the plastic produce bag 150A proximate the openable mouth 155A when the frictional element 142 is in contact with the portion of the rear sidewall 154A proximate the openable mouth 155A, while permitting a portion of the front sidewall 152A proximate the openable mouth 155A to move relative to the retained in place portion of the rear sidewall 154A to open the mouth 155A of the plastic produce bag 150A in response to a lateral force applied by a consumer to the portion of the front sidewall 152A proximate the openable mouth 155A.

In some embodiments, the frictional element 142 of the bag opening facilitator 140 includes one or more elastomeric or rubber materials. Examples of suitable elastomeric or rubber materials include but are not limited to saturated and unsaturated rubbers, thermoplastic elastomers, combinations thereof, of the like.

In some embodiments, instead of including a rubber material, the frictional element 142 of the bag opening facilitator 140 may include one or more adhesive material applied (e.g., by coating, spraying, or the like) directly to an exterior surface of the separator tab 134 and/or an exterior surface of one or more supporting rods 134 of the bag opening facilitator 140. Suitable adhesive materials include but are not limited to adhesives that would provide a higher coefficient friction than adjacent portions of the (preferably metallic or plastic) separator tab 134 not including the applied adhesive material, but which would not attach to the plastic bag with a force sufficient to prevent detachment of the rear side wall 154A of the leading plastic produce bag 150A away from the bag opening facilitator 140 without ripping through the rear side wall 154A. Examples of suitable adhesive materials include, but are not limited to, acrylate or acrylic oligomers, combinations thereof, or the like.

In some embodiments, instead of including a rubber or adhesive material, the frictional element 142 of the bag opening facilitator 140 may include one or more fiber or cloth material. Examples of suitable fiber or cloth materials include but are not limited to cellulosic materials, polyester fibers, combinations thereof, or the like. A suitable fiber-based or cloth-based frictional element 142 of the bag opening facilitator 140 would provide a higher coefficient of friction than the adjacent surfaces of the (preferably metallic or plastic) separator tab 134 and/or one or more supporting rods 132 relative to the rear sidewall 154A of the leading plastic produce bag 150A, thereby facilitating the separation of the front sidewall 152A at the leading end of the plastic produce bag 150A from opposing portions of the rear side wall 154A to provide for the opening of the mouth 155A of the leading plastic produce bag 150A, as shown in FIGS. 3-4. In other words, the elastomeric, rubber, adhesive, fiber, and/or cloth frictional elements 142 of the bag opening facilitator 140 described above provide a higher coefficient of friction than the coefficient of friction between the interior surfaces of the front and rear sidewalls 152A and 154A at the leading end of the leading plastic produce bag 150A, thereby facilitating the separation of interior surface portions of the front sidewall 152A at the leading end of the plastic produce bag 150A from the opposing interior surface portions of the rear sidewall 154A while retaining the exterior portions of the rear sidewall 154A that are in contact with the frictional element 142 in place to provide for the opening of the mouth 155A of the leading plastic produce bag 150A, as shown in FIGS. 3-4.

In some embodiments, the bag opening facilitator 140 may include printed indicia 144 that identifies the opening facilitator 140 as such to the consumer. Such printed indicia 144 may include printed letters "BAG OPENING ASSISTANT" as shown in FIG. 1, or another phrase that would clearly indicate to a consumer that the opening facilitator 140 may be used by the consumer to facilitate the opening of the plastic produce bag 150A.

In some embodiments, the bag opening facilitator 140 may further include additional printed indicia 146 that may indicate to a consumer how the opening facilitator 140 is to be used to open the mouth 155A of the plastic produce bag 150A. For example, in the embodiment of FIG. 1, the bag opening facilitator 140 includes a second set of printed indicia in the form of printed directional arrows 146 visibly identifying a suggested direction of movement of the portion of the upper layer 162 proximate the leading end of the roll of flexible material 160 relative to the opposing portion of the lower layer 164 of the roll of flexible material 160 retained in place by the frictional element 142 of the bag opening facilitator 140 in order to form an opening 165 between the upper and lower layers 162 and 164 of the roll of flexible material 160, as shown in FIG. 3. It will be appreciated that instead of, or in addition to the directional arrows shown in FIG. 1, the second set of printed indicia 146 may include only printed letters that provide written instructions to a consumer as to how to create an opening between the upper and lower layers 162 and 154 of the roll of flexible material 160 (as in FIG. 3) to open the mouth 155A of the plastic produce bag 150A (as in FIG. 4) by utilizing the bag opening facilitator 140.

In some embodiments, the bag opening facilitator 140 is in the form of a label that may be detachably or non-detachably attached to the separator tab 134 of the bag separator 130. For example, the bag opening facilitator 140 may have a first side including the frictional element 142 (e.g., including an elastomeric, rubber, adhesive, fiber, and/or cloth material) and a second, opposite, side including one or more adhesive materials that permit the attachment of the bag opening facilitator 140 to the separator tab 134 as shown in FIG. 1 (or to one or more supporting rods 134).

It will be appreciated that instead of being a distinct component such as a label, the bag opening facilitator 140 including the frictional element 142 may be formed directly on the surface of separator tab 134 (or on the surface of one or more supporting rods 132) of the bag separator 130 by using a technique including but not limited to scraping, knurling, or the like, that is capable of creating a roughened surface on the separator tab 134 (or on one or more of the supporting rods 132) sufficient to provide a higher coefficient of friction than the unroughened adjacent surfaces of the separator tab 134 (or the supporting rods 132). Similarly, it will be appreciated that the bag opening facilitator 140 including the frictional element 142 may be formed by way of applying an elastomeric, rubber, adhesive, fiber, and/or cloth material directly onto the surface of separator tab 134 (or onto the surface of one or more supporting rods 132) of the bag separator 130. It will be appreciated that in some embodiments, the bag opening facilitator 140 may be a metallic plate bolted onto, welded onto, or detachably or non-detachably clipped onto the separator tab 134 or onto one or more supporting rods 132 of the bag separator 130.

An exemplary method of facilitating a consumer in opening a plastic produce bag 150 according to one embodiment is described below. The exemplary method includes providing a roll of flexible material 160 on a spindle 122 of a plastic produce bag dispenser 110 as shown in FIG. 1. As shown in FIG. 4, each of the plastic produce bags 150A and 150B in the roll of flexible material 160 includes a front sidewall 152, a rear sidewall 154, an openable mouth 155 proximate a first end of the plastic produce bag 150A and 150B, and a closed second end 158. As shown in FIG. 4, the roll of flexible material 160 is configured such that adjacent plastic produce bags 150A and 150B in the roll of flexible material 160 are separable from each other along a line of weakness 166, and the lines of weakness 166 are spaced at predetermined intervals along the length of the roll of flexible material 160.

As can be seen in FIGS. 1-4, the method further includes providing a bag separator 130 configured to permit separation of a leading plastic produce bag 150A from an adjacent plastic produce bag 150B along the line of weakness 166 and a providing a bag opening facilitator 140 including a frictional element 142 having a higher coefficient of friction relative to surfaces of the front and rear sidewalls 152A and 154A of the leading plastic produce bag 150A than portions of the separator tab 134 of the bag separator 130 adjacent the bag opening facilitator 140. With reference to FIGS. 3 and 4, the method further includes retaining in place a portion of the rear sidewall 154A proximate the openable mouth 155A of the leading plastic produce bag 150A when in contact with this portion of the rear sidewall 154A while permitting a portion of the front sidewall 152A proximate the openable mouth 155A to move relative to the retained in place portion of the rear sidewall 154A to open the mouth 155A of the plastic produce bag 150A in response to a force applied by a consumer to the portion of the front sidewall 152A proximate the openable mouth 155A.

In use, a consumer of a retail or grocery location where the produce bag dispenser 110 may be installed proximate a product display may pull the leading plastic produce bag 150A in a direction shown by the arrow in FIG. 2 such that a portion of the leading plastic produce bag 150A overlies at least a portion of the bag separator 130 and the bag opening facilitator 140. With the leading plastic produce bag 150A positioned as shown in FIG. 2, the consumer may use the fingers on the consumer's hand to move a portion of the upper layer 162 of the roll of flexible material 160 in a direction shown in FIG. 3. The movement of the portion of the upper layer 162 of the roll of flexible material 160 in contact with the user's thumb, in combination with the retention of the opposing portion of the lower layer 164 of the roll of flexible material 160 in place by the frictional element 142 of the bag opening facilitator 140, separates the leading ends of the upper and lower layers of the roll of flexible material 160 to form an opening 165 therebetween as shown in FIG. 3.

It will be appreciated that the user may move the upper layer 162 of the roll of flexible material 160 in only one direction or in more than one direction more than one direction to effectuate the formation of the opening 165 between the upper and lower layers 162 and 164 of the roll of flexible material 160. For example, the upper layer 162 may be moved only in the direction shown in FIG. 3 (e.g., in a direction perpendicular to the direction of movement of the plastic produce bag 150A off the roll of flexible material 160) to effectuate the formation of the opening 165 between the upper and lower layers 162 and 164 of the roll of flexible material 160.

In some situations, the static cohesion between the upper and lower layers 162 and 164 of the roll of flexible material 160 may be such that movement of the upper layer 162 once in one direction may not be sufficient, and the consumer may be required to move the upper layer 162 once in the direction indicated by the left-facing arrow on the bag opening facilitator 140 and then once in an opposite direction indicated by the right-facing arrow on the bag opening facilitator 140 to effectuate the formation of the opening 165 between the upper and lower layers 162 and 164 of the roll of flexible material 160. In certain situations, the consumer may be required to move the upper layer 162 in the directions indicated by the left-facing and right-facing arrows on the bag opening facilitator 140 multiple times (in a reciprocating fashion) to effectuate the formation of the opening 165 between the upper and lower layers 162 and 164 of the roll of flexible material 160.

With the mouth of the leading produce bag 150A opened as shown in FIG. 3, the consumer may then pull down on the leading produce bag 150A in the direction shown in FIG. 4, using the bag separator tab 134 of the bag separator 130 as a hinge area to initiate a tear between the leading plastic produce bag 150A and its adjacent plastic produce bag 150B at the line of weakness 166 in the roll of flexible material 160, as shown in FIG. 4. The force being applied by the consumer propagates the initiated tear along the line of weakness 166 to separate the sealed portion 168 from the line of weakness 166 and thereby separate the closed bottom end 158A of the leading plastic produce bag 150A from the (closed) mouth 155B of the plastic produce bag 150B, as shown in FIG. 4. When the tear initiated by the consumer propagates along an entire length of the line of weakness 166, the leading plastic produce bag 150*a*, with its mouth 155A at least in part open, is fully separated from the roll of flexible material 160, enabling the consumer to place the consumer's selected products into the plastic produce bag 150A without having to struggle with the opening of the mouth 155*a* of the separated plastic produce bag 150A.

The systems and methods described herein advantageously allow customers to easily open the mouth of a plastic or paper bag being dispensed from a roll on a bag dispenser. For example, the bag opening facilitator according to the embodiment described herein allows the consumers to open the mouth of a bag without having to wet the consumer's fingers and without having to figure out which end of the bag is the mouth end and which end of the bag is the closed end. As such, the consumers are provided with time savings and are relieved of some frustration when shopping for products that require to be placed in bags.

Those skilled in the art will recognize that a wide variety of other modifications, alterations, and combinations can also be made with respect to the above described embodiments without departing from the scope of the invention, and that such modifications, alterations, and combinations are to be viewed as being within the ambit of the inventive concept.

What is claimed is:

1. A plastic produce bag dispenser for facilitating a consumer to open a plastic produce bag, the dispenser comprising:

a frame including a spindle configured to hold and permit dispensing of a roll of plastic produce bags, each of the plastic produce bags in the roll including an upwardly facing sidewall, a downwardly facing sidewall, an openable mouth proximate a first end of the plastic produce bag and a closed second end, adjacent plastic produce bags in the roll being separable from each other along a line of weakness;

a bag separator coupled to the frame configured to permit separation of a leading plastic produce bag from an adjacent plastic produce bag along the line of weakness, the bag separator comprising a forwardly facing surface and a backwardly facing surface;

the forwardly facing surface of the bag separator including a forwardly facing bag opening facilitator including a forwardly facing frictional element having a coefficient of friction relative to surfaces of the upwardly facing and downwardly facing sidewalls of the leading plastic produce bag that is higher than a coefficient of friction of portions of the bag separator adjacent the forwardly facing bag opening facilitator;

wherein the frame supports the roll of the plastic produce bags such that the downwardly facing sidewall of the leading plastic produce bag overlays the forwardly facing frictional element of the forwardly facing bag opening facilitator, and wherein the forwardly facing frictional element of the forwardly facing bag opening facilitator is configured to retain in place a portion of the downwardly facing sidewall of the leading plastic produce bag proximate the openable mouth when in contact with the portion of the downwardly facing sidewall of the leading plastic produce bag proximate the openable mouth while permitting a portion of the upwardly facing sidewall of the leading plastic produce bag proximate the openable mouth to move relative to the retained in place portion of the downwardly facing sidewall of the leading plastic produce bag to open the mouth of the leading plastic produce bag in response to a force applied by a consumer to the portion of the upwardly facing sidewall of the leading plastic produce bag proximate the openable mouth.

2. The dispenser of claim 1, wherein the forwardly facing bag opening facilitator comprises a forwardly facing first side including the frictional element and a backwardly facing second side opposite the forwardly facing first side wherein the backwardly facing second side includes an adhesive material attached to the forwardly facing surface of the bag separator.

3. The dispenser of claim 1, wherein the forwardly facing frictional element of the forwardly facing bag opening facilitator comprises at least one rubber material.

4. The dispenser of claim 1, wherein the forwardly facing frictional element of the forwardly facing bag opening facilitator comprises at least one adhesive material.

5. The dispenser of claim 1, wherein the forwardly facing frictional element of the forwardly facing bag opening facilitator comprises at least one thermoplastic elastomer material.

6. The dispenser of claim 1, wherein the forwardly facing frictional element of the forwardly facing bag opening facilitator comprises at least one fiber material.

7. The dispenser of claim 1, wherein the forwardly facing frictional element of the forwardly facing bag opening facilitator comprises at least one abrasive surface.

8. The dispenser of claim 1, wherein the forwardly facing frictional element of the forwardly facing bag opening facilitator is applied directly onto a surface of the bag separator.

9. The dispenser of claim 1, wherein the forwardly facing bag opening facilitator further comprises a first set of forwardly facing printed indicia visibly identifying the forwardly facing bag opening facilitator to the consumer.

10. The dispenser of claim 9, wherein the forwardly facing bag opening facilitator further comprises a second set of forwardly facing printed indicia visibly identifying a suggested direction of movement of the portion of the upwardly facing sidewall of the leading plastic produce bag proximate the openable mouth relative to the retained in place portion of the downwardly facing sidewall of the leading plastic produce bag to open the mouth of the leading plastic produce bag.

11. A method of facilitating a consumer in opening a plastic produce bag, the method comprising:

providing a roll of plastic produce bags on a plastic produce bag dispenser including a spindle, each of the plastic produce bags in the roll including an upwardly facing sidewall, a downwardly facing sidewall, an openable mouth proximate a first end of the plastic produce bag, and a closed second end, the roll being configured such that adjacent plastic produce bags in the roll are separable from each other along a line of weakness;

providing a bag separator configured to permit separation of a leading plastic produce bag from an adjacent plastic produce bag along the line of weakness, the bag separator comprising a forwardly facing surface and a backwardly facing surface;

providing a forwardly facing bag opening facilitator on the forwardly facing surface of the bag separator, wherein the forwardly facing bag opening facilitator includes a forwardly facing frictional element having a coefficient of friction relative to surfaces of the upwardly facing and downwardly facing sidewalls of the leading plastic produce bag that is higher than a coefficient of friction of portions of the bag separator adjacent the forwardly facing bag opening facilitator; wherein the plastic produce bag dispenser supports the roll of the plastic produce bags such that the downwardly facing sidewall of the leading plastic produce bag overlays the forwardly facing frictional element of the forwardly facing bag opening facilitator; and retaining in place a portion of the downwardly facing sidewall of the leading plastic produce bag proximate the openable mouth when in contact with the portion of the downwardly facing sidewall of the leading plastic produce bag proximate the openable mouth while permitting a portion of the upwardly facing sidewall of the leading plastic produce bag proximate the openable mouth to move relative to the retained in place portion of the downwardly facing sidewall of the leading plastic produce bag to open the mouth of the leading plastic produce bag in response to a force applied by a consumer to the portion of the upwardly facing sidewall of the leading plastic produce bag proximate the openable mouth.

12. The method of claim 11, wherein the forwardly facing bag opening facilitator comprises a forwardly facing first side including the frictional element and a second side opposite the forwardly facing first side wherein the backwardly facing second side includes an adhesive material attached to the forwardly facing surface of the bag separator.

13. The method of claim 11, wherein forwardly facing frictional element of the forwardly facing bag opening facilitator comprises at least one rubber material.

14. The method of claim 11, wherein the forwardly facing frictional element of the forwardly facing bag opening facilitator comprises at least one adhesive material.

15. The method of claim 11, wherein the forwardly facing frictional element of the forwardly facing bag opening facilitator comprises at least one thermoplastic elastomer material.

16. The method of claim 11, wherein the forwardly facing frictional element of the forwardly facing bag opening facilitator comprises at least one fiber material.

17. The method of claim 11, wherein the forwardly facing frictional element of the forwardly facing bag opening facilitator comprises at least one abrasive surface.

18. The method of claim 11, further comprising applying the forwardly facing frictional element of the forwardly facing bag opening facilitator directly onto a surface of the bag separator.

19. The method of claim 11, further comprising providing a forwardly facing first set of printed indicia on the forwardly facing bag opening facilitator to visibly identify the forwardly facing bag opening facilitator to the consumer.

20. The method of claim 19, further comprising providing a forwardly facing second set of printed indicia visibly identifying a suggested direction of movement of the portion of the upwardly facing sidewall of the leading plastic produce bag proximate the openable mouth relative to the retained in place portion of the downwardly facing sidewall of the leading plastic produce bag to open the mouth of the leading plastic produce bag.

* * * * *